US007969091B2

(12) United States Patent
Lin et al.

(10) Patent No.: US 7,969,091 B2
(45) Date of Patent: Jun. 28, 2011

(54) FIELD-EMISSION APPARATUS OF LIGHT SOURCE COMPRISING A LOW PRESSURE GAS LAYER

(75) Inventors: Yi-Ping Lin, Changhua County (TW); Jung-Yu Li, Taipei County (TW); Shih-Pu Chen, Hsinchu (TW); Wei-Chih Lin, Taipei County (TW); Lian-Yi Cho, Miaoli County (TW)

(73) Assignee: Industrial Technology Research Institute, Hsinchu (TW)

( * ) Notice: Subject to any disclaimer, the term of this patent is extended or adjusted under 35 U.S.C. 154(b) by 411 days.

(21) Appl. No.: 11/747,234

(22) Filed: May 11, 2007

(65) Prior Publication Data

US 2008/0211381 A1 Sep. 4, 2008

(30) Foreign Application Priority Data

Mar. 2, 2007 (TW) ..... 96107136 A

(51) Int. Cl.
*H01J 17/20* (2006.01)
*H01J 61/12* (2006.01)

(52) U.S. Cl. ..... 313/577; 313/568; 313/346 R; 313/631

(58) Field of Classification Search ..... 313/495, 313/309, 497, 577, 637, 361, 346 R
See application file for complete search history.

(56) References Cited

U.S. PATENT DOCUMENTS 6,346,775 B1 * 2/2002 Lee et al. ..... 315/169.3
7,586,251 B2 9/2009 Jung et al.
2002/0146853 A1 * 10/2002 Karpov et al. ..... 438/20
2003/0001492 A1 1/2003 Pei et al.
2005/0062413 A1 * 3/2005 Francke ..... 313/512
2006/0125373 A1 * 6/2006 Lin et al. ..... 313/495
2006/0232187 A1 10/2006 Lin et al.
2007/0035941 A1 2/2007 Lee et al.
2007/0049154 A1 * 3/2007 Chang et al. ..... 445/24
2007/0069235 A1 * 3/2007 Ueno et al. ..... 257/109
2007/0128413 A1 6/2007 Chuang et al.
2007/0164651 A1 * 7/2007 Fu et al. ..... 313/491
2007/0200509 A1 8/2007 Lin et al.
2007/0222364 A1 * 9/2007 Qian et al. ..... 313/496
2007/0229003 A1 * 10/2007 Park et al. ..... 315/324
2008/0100916 A1 * 5/2008 Suhl ..... 359/601
2008/0143241 A1 * 6/2008 Li et al. ..... 313/496
2008/0150835 A1 * 6/2008 Paik et al. ..... 345/60
2008/0150876 A1 6/2008 Kuo

FOREIGN PATENT DOCUMENTS

CN 1259684 7/2000

(Continued)

OTHER PUBLICATIONS

"1st Office Action of Chinese counterpart application", issued on Jun. 26, 2009, p. 1-9.

*Primary Examiner* — Nimeshkumar D Patel
*Assistant Examiner* — Jose M Diaz
(74) *Attorney, Agent, or Firm* — Jianq Chyun IP Office

(57) ABSTRACT

An apparatus of light source includes a cathode structure, an anode structure, a fluorescent layer, a secondary electron generating layer, and a low-pressure gas layer. The fluorescent layer is located between the cathode structure and the anode structure. The low-pressure gas layer is filled between the cathode structure and the anode structure. The secondary electron generating layer is located on the cathode structure. The secondary electron generating layer can generate additional secondary electrons to hit the fluorescent layer for improving the performance of the light source.

20 Claims, 5 Drawing Sheets

FOREIGN PATENT DOCUMENTS

| | | | |
|---|---|---|---|
| CN | 1618113 | | 5/2005 |
| CN | 1794399 | | 6/2006 |
| CN | 1940676 | | 4/2007 |
| EP | 1691585 | A1 * | 8/2006 |
| JP | 2005-044616 | | 2/2005 |
| JP | 2006-179467 | | 7/2006 |

* cited by examiner

FIELD-EMISSION APPARATUS OF LIGHT SOURCE COMPRISING A LOW PRESSURE GAS LAYER

CROSS-REFERENCE TO RELATED APPLICATION

This application claims the priority benefit of Taiwan application serial no. 96107136, filed Mar. 2, 2007. All disclosure of the Taiwan application is incorporated herein by reference.

BACKGROUND OF THE INVENTION

1. Field of the Invention

The present invention relates to a flat light source apparatus for a liquid crystal backlight module.

2. Description of Related Art

An apparatus of light source is widely used in daily life. Conventional apparatus of light source such as a bulb using a filament conducted to generate a high temperature to produce a visible light source. This kind of bulb is basically a point light source. Then, a tubular light source is developed. After a long time of development and changes, a flat light source apparatus is also provided, for example, widely used in a flat panel display.

A plurality of mechanisms can be used to generate a light source. FIG. 1 is a schematic cross-sectional view of a conventional flat light source apparatus mechanism. Referring to FIG. 1, the light emitting mechanism is connected to a power source 106 through two electrode structures 100 and 102 to generate an electric field under an operating voltage, and uses a gas to discharge, which is also referred to as plasma discharge, so as to ionize a gas 104 to produce electrons 110. The electrons 110 are accelerated by the electric field to hit fluorescent layers 108*a*, 108*b*, and 108*c* respectively corresponding to red, green, and blue on the electrode structure 102. A visible light 112 is produced and emitted through the effect of the fluorescent layers. Herein, the electrode structure 100 is a light exit surface, which is usually a light transmissive material composed of a glass substrate and an indium tin oxide (ITO) transparent conductive layer.

Another light generating mechanism is a field-emission mechanism as shown in FIG. 2. FIG. 2 is a schematic cross-sectional view of another conventional flat light source apparatus mechanism. The conventional flat light source apparatus includes a glass substrate 120, a cathode structure layer 122, a plurality of conical conductors 124, a gate layer 126, an anode structure layer 128, and a fluorescent layer 130. The cathode structure layer 122 is disposed on the glass substrate 120. The plurality of conical conductors 124 is disposed on the cathode structure layer 122. A gate layer 126 is disposed on the conical conductors 124. A plurality of holes corresponding to the conical conductors 124 is provided on the gate layer 126. The anode structure layer 128 has a transparent anode layer disposed on a glass substrate. Moreover, the fluorescent layer 130 is disposed on the anode structure layer 128. Under the high electric field between the anode and the cathode, the electrons 132 are escaped from the top of the conical conductor 124, and after being accelerated by the electric field, hit the fluorescent layer 130 to emit a visible light.

The above two conventional light emitting mechanisms have their own advantages and disadvantages. The gas discharge mechanism can be easily achieved and has a simple structure, but is power-consuming since plasma is needed to be generated in the process. The field-emission light source is one of cold light sources, and is similar to a cathode ray tube (CRT) in principle, in which the high electric field between anode and cathode force the electrons to escape and hit the fluorescent powder coated on the anode so as to emit light. This light source is advantageous in high brightness and low power consumption, and can be easily fabricated into a flat structure. However, it is disadvantageous that a uniform emission material must be grown or coated on the cathode, for example, a spindle structure must be formed or a carbon nanotube is used. This flat fluorescent lamp needs a support to separate the anode and the cathode, and a vertical distance between the anode and the cathode must be adjusted carefully. Due to a small error tolerance, costs of a great number of structure designs and the yield must be taken into consideration in mass application, and the uniformity of the overall light emitting brightness is also difficult to control. Moreover, the vacuum packaging is also one of the problems.

SUMMARY OF THE INVENTION

The present invention provides an apparatus of light source, which can be easily fabricated into a flat light source in the absence of a high vacuum degree, and has a preferred brightness and light-emitting efficiency.

The present invention provides an apparatus of light source, which can be easily fabricated into a flat light source without in the absence of a high vacuum degree, and can operate under a lower operating voltage.

The present invention provides an apparatus of light source, which includes a cathode structure, an anode structure, a secondary electron generating layer, a fluorescent layer, and a low-pressure gas layer. The anode structure faces the cathode structure. The secondary electron generating layer is located on the cathode structure. The fluorescent layer is located between the cathode structure and the anode structure. The low-pressure gas layer is filled between the cathode structure and the anode structure, and has the electrical conducting effect. The low-pressure gas layer has an electron mean free path for allowing at least sufficient amount of electrons to directly hit the fluorescent layer under an operating voltage.

The present invention also provides an apparatus of light source, which includes a cathode structure, an anode structure, a discharge layer, a fluorescent layer, and a low-pressure gas layer. The anode structure faces the cathode structure. The discharge layer is located on at least the cathode structure or the anode structure. The fluorescent layer is located between the cathode structure and the anode structure. The low-pressure gas layer is filled between the cathode structure and the anode structure, and has electrical conducting effect. The low-pressure gas layer has an electron mean free path for allowing at least sufficient amount of electrons to directly hit the fluorescent layer under an operating voltage.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Some embodiments are given hereinafter for illustrating the features of the present invention, but the present invention is not limited to the embodiments.

First Embodiment

Figure 1:
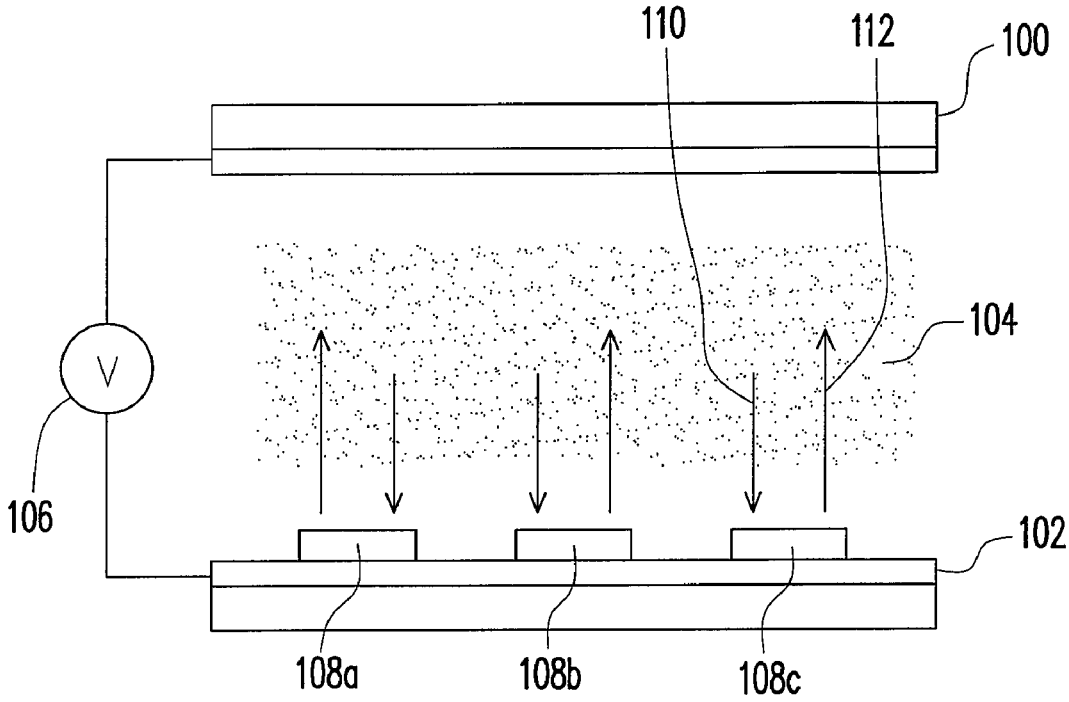
FIG. 1 (PRIOR ART)
FIG. 1 is a schematic cross-sectional view of a conventional flat light source apparatus mechanism.
Figure 2:
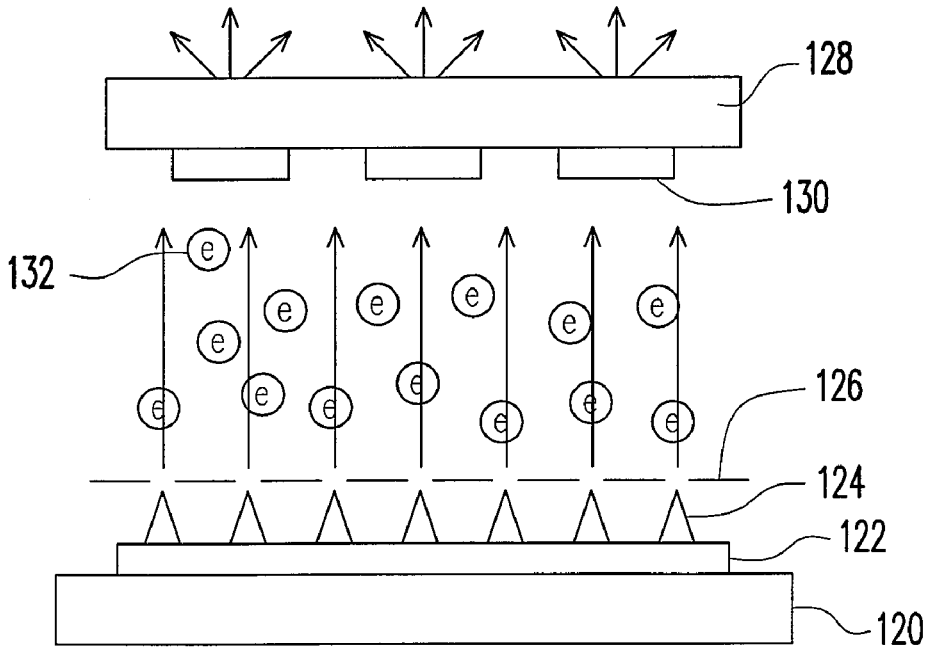
FIG. 2 (PRIOR ART)
FIG. 2 is a schematic cross-sectional view of another conventional flat light source apparatus mechanism.
Figure 3:
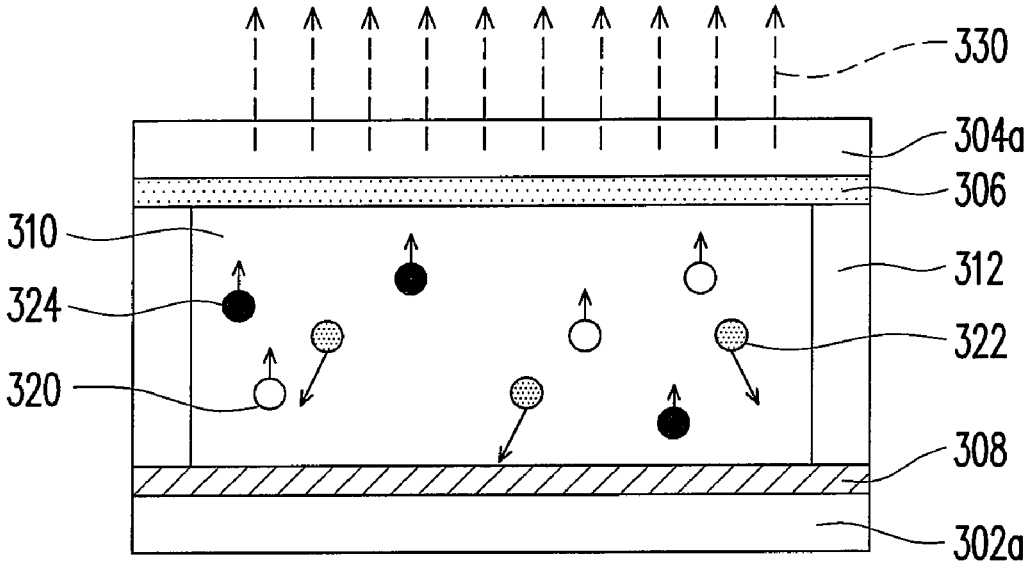
FIG. 3 is a schematic cross-sectional view of an apparatus of light source according to an embodiment of the present invention.

FIG. 3 is a schematic cross-sectional view of an apparatus of light source according to an embodiment of the present invention. Referring to FIG. 3, the apparatus of light source includes a cathode structure 302*a*, an anode structure 304*a*, a fluorescent layer 306, a secondary electron generating layer 308, and a low-pressure gas layer 310.

The material of the cathode structure 302*a* is a metal, and preferably a metal of high reflectivity. The anode structure 304*a* faces the cathode structure 302*a*. The anode structure 304*a* is a light transmissive structure, and is made of, for example, indium tin oxide (ITO), fluorine-doped tin oxide (FTO), or other transparent conductive oxide (TCO) materials. The cathode structure 302*a* and the anode structure 304*a*, for example, mainly include a substrate and an electrode layer on the substrate. The actual structure of the cathode structure 302*a* and the anode structure 304*a* can be changed according to the actual design, which can be understood by persons of ordinary skill in the art, and will not described in detail herein.

The fluorescent layer 306 is disposed between the cathode structure 302*a* and the anode structure 304*a*, and generally, for example, disposed on the anode structure 304*a*.

The secondary electron generating layer 308 is disposed on cathode structure 302*a*. The material of the secondary electron generating layer 308 is, for example, magnesium oxide (MgO), terbium oxide ($Tb_2O_3$), lanthanum oxide ($La_2O_3$), or cerium oxide ($CeO_2$).

The low-pressure gas layer 310 is formed between the cathode structure 302 and the anode structure 304, and a low-pressure gas in a range of $1\times10^{-2}$-$1\times10^{-3}$ torr is filled therein, such that the electron mean free path is approximately greater than 5 mm.

In one embodiment, the apparatus of light source in FIG. 3 further includes a sidewall structure 312 which separates the cathode structure 302*a* from anode structure 304*a* for a certain distance, and also encloses a low-pressure gas layer 310 for the low-pressure gas to be filled in.

The embodiment of the present invention uses a gas discharge mechanism to uniformly produce sufficient amount of electrons 320, and also uses the field-emission mechanism to allow the ionized electrons 320 to hit the fluorescent layer 306, so as to produce the desired light. Since the ionized positive ions 322 in the gas may hit the secondary electron generating layer 308, when the positive ions hit the secondary electron generating layer 308, additional secondary electrons 324 are produced to hit the fluorescent layer 306, so as to improve the light-emitting efficiency.

In this embodiment, the anode structure 304*a* is a light transmissive structure, and when the electrons 320 hit the fluorescent layer 306, the produced light 330 passes through the anode structure 304*a*, so that this kind of light source apparatus is also referred as a transmissive light source apparatus. Moreover, in the transmissive light source apparatus, the cathode structure 302*a* is a metal of high reflectivity, thus increasing reflectivity and improving brightness and light-emitting efficiency.

It should be noted that the filled gas is used for conducting, so the selected gas is preferably a gas that can be easily ionized and conducted, but other kinds of gas can also be used. The gas in use is, for example, atmospheric air, He, Ne, Ar, Kr, Xe, $H_2$, and $CO_2$. The filled gas is in a medium vacuum, so the mean electron free path is long enough for sufficient amount of electrons to be accelerated by the electric field to gain enough energy, so as to hit the fluorescent layer 306 to emit the desired light.

Figure 4:
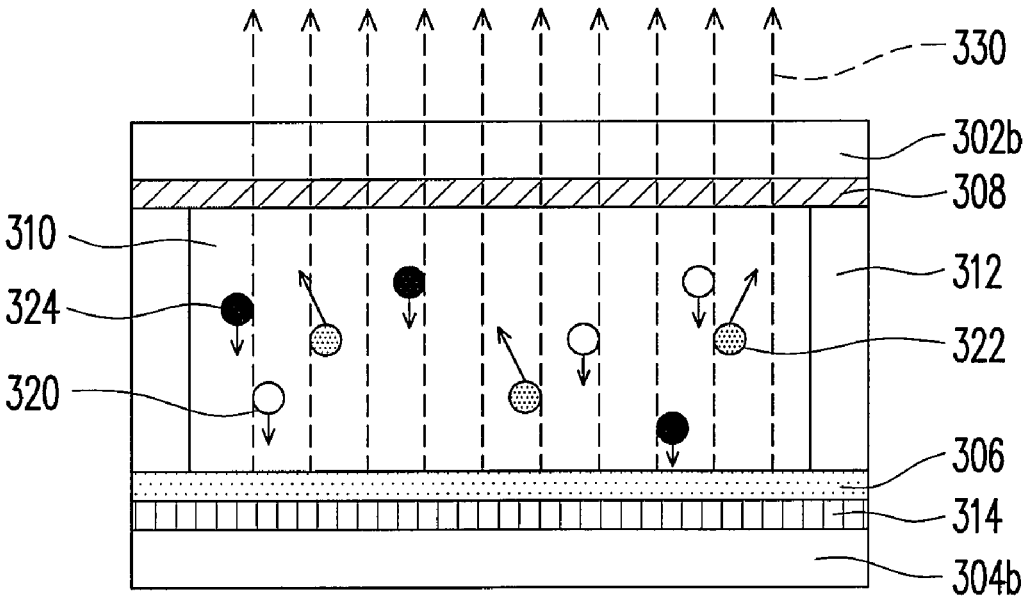
FIG. 4 is a schematic cross-sectional view of an apparatus of light source according to an embodiment of the present invention.

The embodiment of FIG. 3 can also be implemented in another form as shown in FIG. 4. FIG. 4 is a schematic cross-sectional view of an apparatus of light source according to an embodiment of the present invention. Referring to FIG. 4, the apparatus of light source includes a cathode structure 302*b*, an anode structure 304*b*, a fluorescent layer 306, a secondary electron generating layer 308, and a low-pressure gas layer 310, a sidewall structure 312, and a reflective layer 314.

The apparatus of light source in FIG. 4 is similar to the apparatus of light source in FIG. 3 except that the apparatus of light source in FIG. 4 further includes a reflective layer 314 disposed between the anode structure 304*b* and the fluorescent layer 306. The cathode structure 302*b* is a light transmissive structure, and is made of, for example, indium tin oxide (ITO), fluorine-doped tin oxide (FTO), or other transparent conductive oxide (TCO) materials. The anode structure 304*b* is a light transmissive or a light-tight material.

When the electrons 320 produced by the gas discharge mechanism and the additional secondary electrons 324 produced as the positive ions 322 hit the secondary electron generating layer 308 hit the fluorescent layer 306, the produced light 330 passes through the cathode structure 302*b* after being reflected by the reflective layer 314, so that this kind of light source apparatus is also referred to as a reflective light source apparatus. Moreover, in the reflective light source apparatus, the anode structure 304*b* is preferably a metal of high reflectivity, thus increasing reflectivity and improving brightness and light-emitting efficiency.

The Second Embodiment

Figure 5:
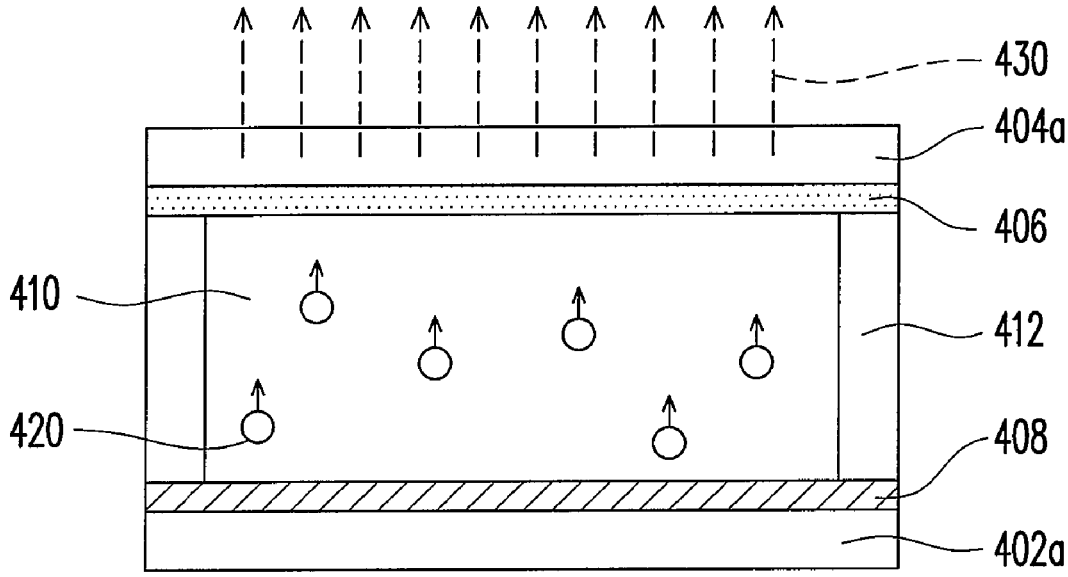
FIG. 5 is a schematic cross-sectional view of an apparatus of light source according to an embodiment of the present invention.

FIG. 5 is a schematic cross-sectional view of an apparatus of light source according to an embodiment of the present invention. Referring to FIG. 5, the apparatus of light source includes a cathode structure 402*a*, an anode structure 404*a*, a fluorescent layer 406, a discharge layer 408, and a low-pressure gas layer 410.

The material of the cathode structure 402*a* is a metal, and preferably a metal of high reflectivity. The anode structure 404*a* faces the cathode structure 402*a*. The cathode structure 402*a* is a light transmissive structure, and is made of, for example, indium tin oxide (ITO), fluorine-doped tin oxide (FTO), or other transparent conductive oxide (TCO) materials. The cathode structure 402*a* and the anode structure 404*a*, for example, mainly include a substrate and an electrode layer on the substrate. The actual structure of the cathode structure 402*a* and the anode structure 404*a* can be changed according to the actual design, which can be understood by persons of ordinary skill in the art, and will not described in detail herein.

The fluorescent layer 406 is disposed between the cathode structure 402*a* and the anode structure 404*a*, and usually, for example, disposed on the anode structure 404*a*.

The discharge layer 408 is disposed on the cathode structure 402*a*. The discharge layer 408 is, for example, made of materials liable to discharge such as metal, carbon nanotube, carbon nanowall, nanocarbonaceous material, columnar zinc oxide (ZnO), and ZnO film.

The low-pressure gas layer 410 is disposed between the cathode structure 402*a* and the anode structure 404*a*, and a low-pressure gas in a range of $1\times10^{-2}$-$1\times10^{-3}$ torr is filled therein, such that, for example, the electron mean free path is approximately greater than 5 mm.

In one embodiment, the apparatus of light source further includes a sidewall structure 412 which separates the cathode structure 402*a* from the anode structure 404*a* for a certain distance, and also encloses a low-pressure gas layer 410 for the low-pressure gas to be filled in.

The present invention uses the gas discharge mechanism to uniformly produce sufficient amount of electrons 420, and also uses the field-emission mechanism to allow the ionized electrons 420 to hit the fluorescent layer 406, so as to produce the desired light. In this embodiment, as the discharge layer 408 is made of a material liable to discharge, the operating voltage is reduced.

The anode structure 404*a* is a light transmissive structure, and is made of, for example, indium tin oxide (ITO), fluorine-doped tin oxide (FTO), or other transparent conductive oxide (TCO) materials. Therefore, when the electrons 420 hit the fluorescent layer 406, the produced light 430 passes through the anode structure 404*a*, so this kind of light source apparatus is also referred to as a transmissive light source apparatus. Moreover, in the transmissive light source apparatus, the cathode structure 402*a* is preferably a metal of high reflectivity, thus increasing reflectivity and improving brightness and light-emitting efficiency.

It should be noted that the filled gas is used for conducting, so the selected gas is preferably a gas which can be easily ionized and conducted, but other kinds of gas can also be used. The used gas is, for example, atmospheric air, He, Ne, Ar, Kr, Xe, $H_2$, and $CO_2$. The filled gas is in a medium vacuum, so the mean electron free path is long enough for sufficient amount of electrons to be accelerated by the electric field to gain enough energy, so as to hit the fluorescent layer 406 to emit the desired light.

Figure 6:
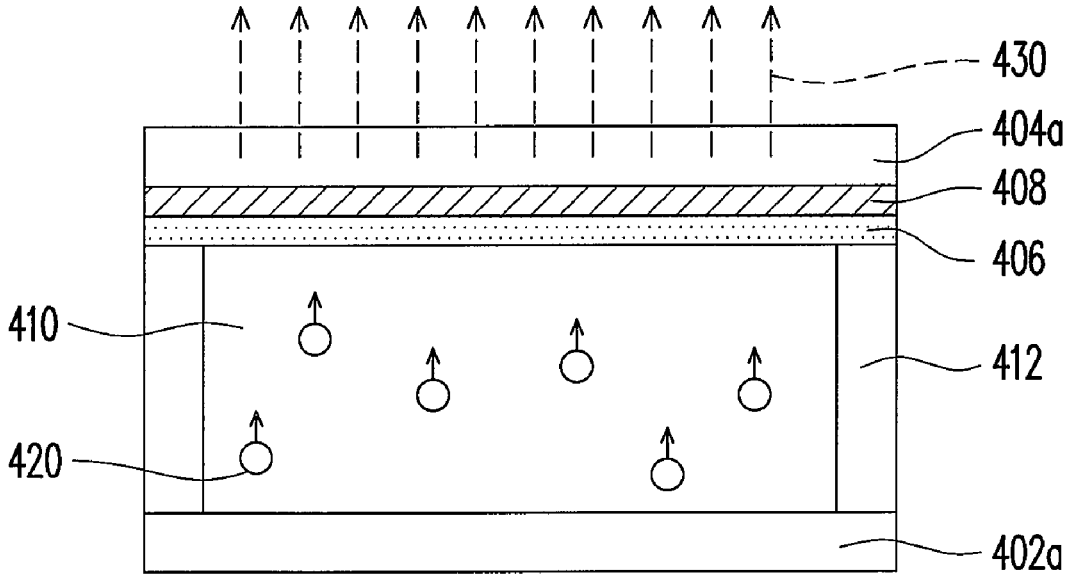
FIG. 6 is a schematic cross-sectional view of an apparatus of light source according to an embodiment of the present invention.

The embodiment of FIG. 5 can also be implemented in another form as shown in FIG. 6. FIG. 6 is a schematic cross-sectional view of an apparatus of light source according to an embodiment of the present invention. The structure and function of the apparatus of light source in FIG. 6 are similar to the structure and function of the apparatus of light source in FIG. 5, so the details will not be repeated herein again. Referring to FIG. 6, the difference between the apparatus of light source of FIG. 6 and the apparatus of light source of FIG. 5 lies in that the discharge layer 408 is disposed between the anode structure 404*a* and the fluorescent layer 406.

Figure 7:
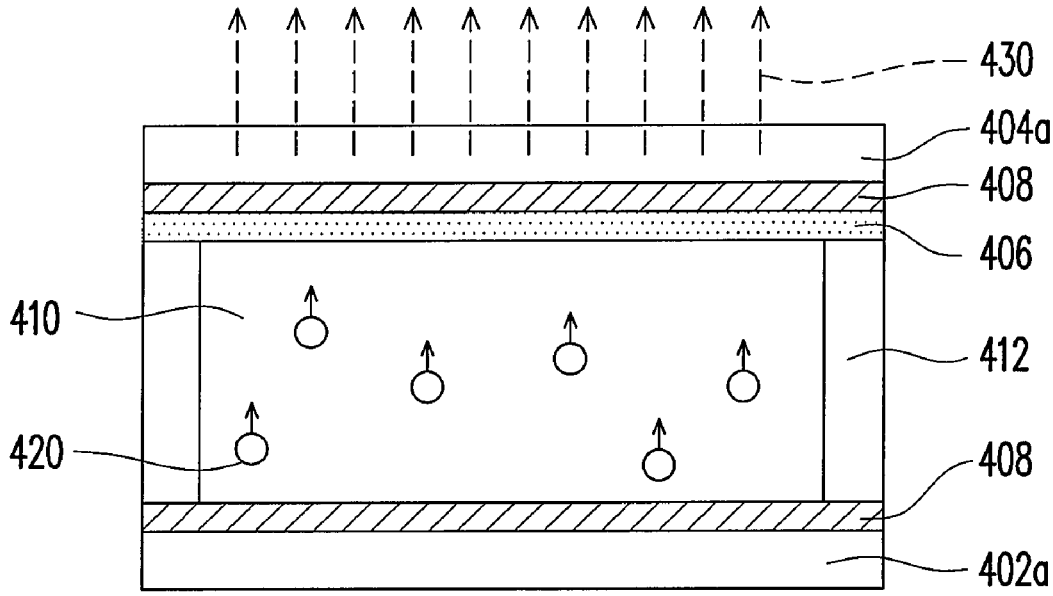
FIG. 7 is a schematic cross-sectional view of an apparatus of light source according to an embodiment of the present invention.

The embodiment of FIG. 5 can also be implemented in another form as shown in FIG. 7. FIG. 7 is a schematic cross-sectional view of an apparatus of light source according to an embodiment of the present invention. The structure and function of the apparatus of light source in FIG. 7 are similar to the structure and function of the apparatus of light source shown in FIG. 5, so the details will not be repeated herein. Referring to FIG. 7, the difference between the apparatus of light source of FIG. 7 and the apparatus of light source of FIG. 5 lies in that the discharge layer 408 is disposed on the cathode structure 402*a* and between the anode structure 404*a* and the fluorescent layer 406.

Figure 8:
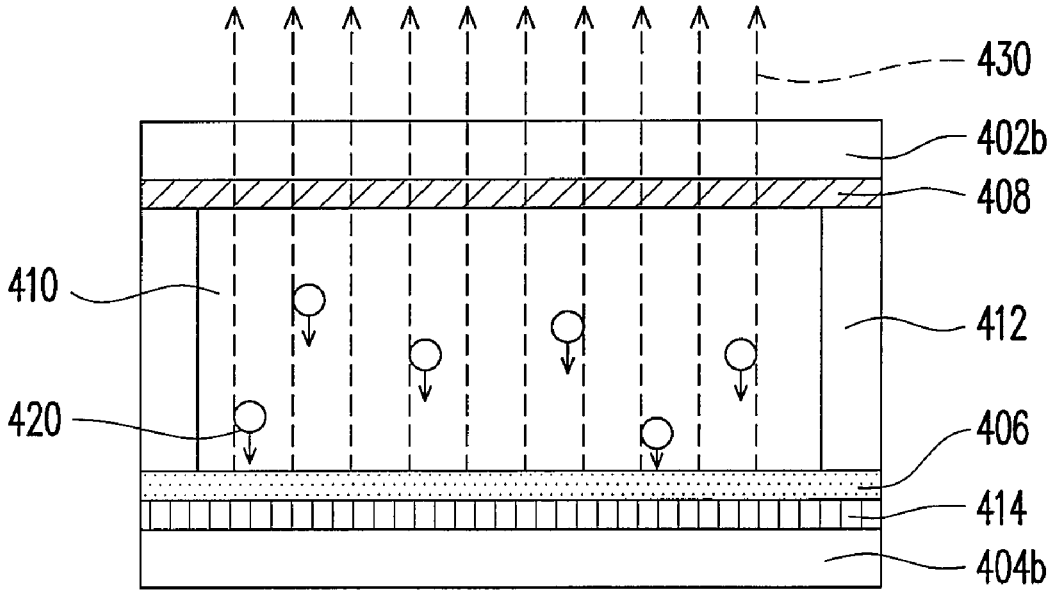
FIG. 8 is a schematic cross-sectional view of an apparatus of light source according to an embodiment of the present invention.

The embodiment of FIG. 5 can also be implemented in another form as shown in FIG. 8. FIG. 8 is a schematic cross-sectional view of an apparatus of light source according to an embodiment of the present invention. Referring to FIG. 8, the apparatus of light source includes a cathode structure 402*b*, an anode structure 404*b*, a fluorescent layer 406, a discharge layer 408, and a low-pressure gas layer 410, a sidewall structure 412, and a reflective layer 414.

The apparatus of light source shown in FIG. 8 is similar to the apparatus of light source shown in FIG. 5. The difference there-between lies in that the apparatus of light source shown in FIG. 8 further includes a reflective layer 414 disposed on the anode structure layer. Moreover, the cathode structure 402*b* is a light transmissive structure, and is made of, for example, indium tin oxide (ITO), fluorine-doped tin oxide (FTO), or other transparent conductive oxide (TCO) materials. The anode structure 404*b* is a light transmissive or a light-tight material.

When the electrons 420 hit the fluorescent layer 406, the produced light 430 passes through the cathode structure 402*b* after being reflected by the reflective layer 414, so this kind of light source apparatus is also referred to as a reflective light source apparatus. In the reflective light source apparatus, the anode structure 404*b* is preferably a metal of high reflectivity, thus increasing reflectivity and improving brightness and light-emitting efficiency.

Figure 9:
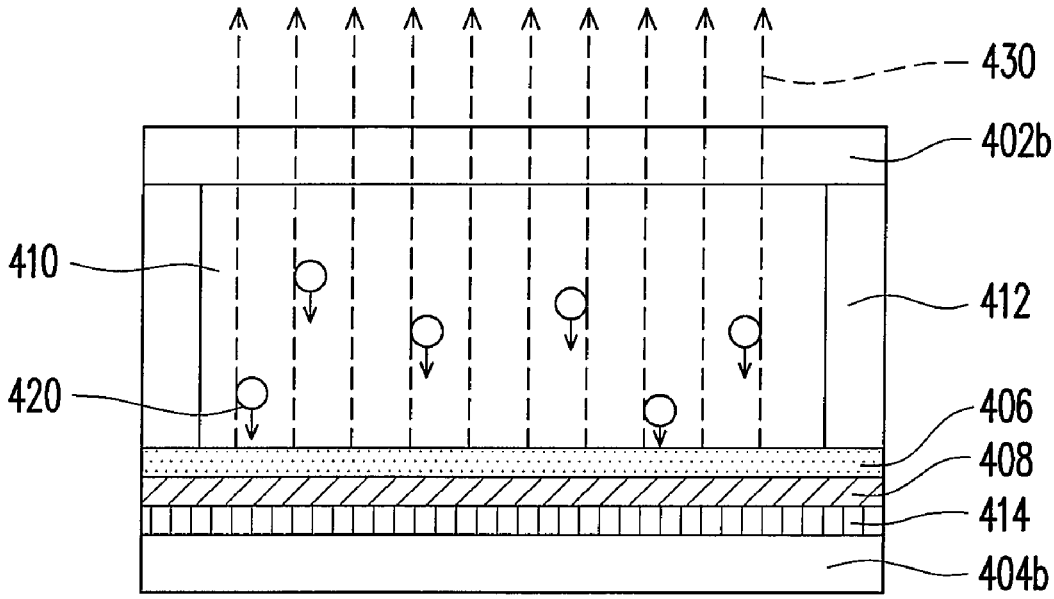
FIG. 9 is a schematic cross-sectional view of an apparatus of light source according to an embodiment of the present invention.

The embodiment of FIG. 8 can also be implemented in another form as shown in FIG. 9. FIG. 9 is a schematic cross-sectional view of an apparatus of light source according to an embodiment of the present invention. The structure and function of the apparatus of light source shown in FIG. 9 are similar to the structure and function of the apparatus of light source shown in FIG. 8, so the details will not be repeated herein. Referring to FIG. 9, the difference between the apparatus of light source of FIG. 9 and the apparatus of light source of FIG. 8 lies in that the discharge layer 408 is disposed between the reflective layer 414 and the fluorescent layer 406.

Figure 10:
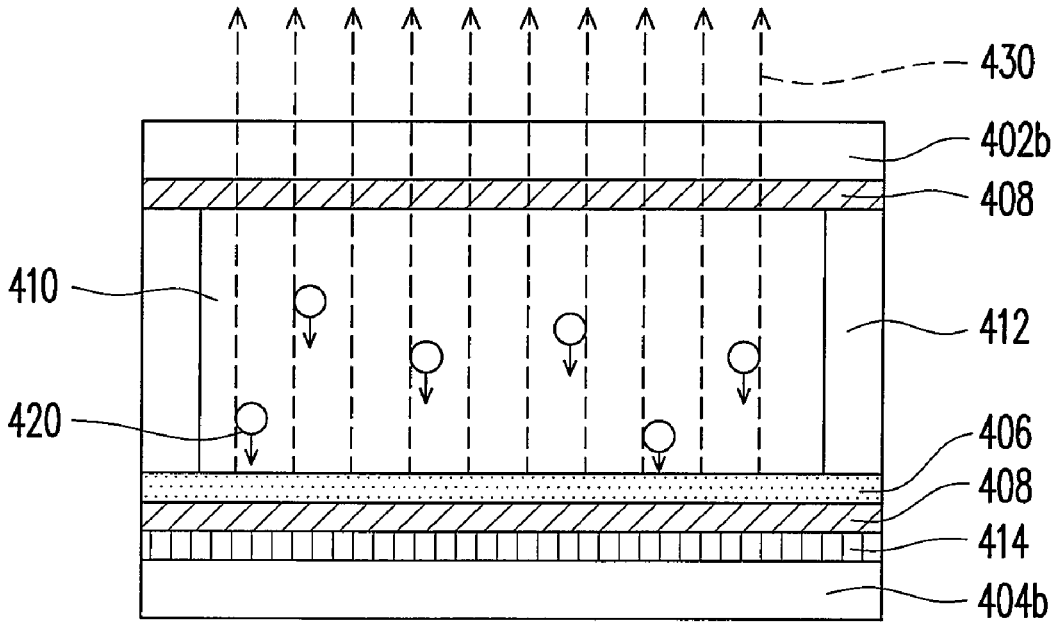
FIG. 10 is a schematic cross-sectional view of an apparatus of light source according to an embodiment of the present invention.

The embodiment of FIG. 8 can also be implemented in another form as shown in FIG. 10. FIG. 10 is a schematic cross-sectional view of an apparatus of light source according to an embodiment of the present invention. In this embodiment, the structure and function of the apparatus of light source shown in FIG. 10 are similar to the structure and function of the apparatus of light source shown in FIG. 8, so the details will not be repeated herein. Referring to FIG. 10, the difference between the apparatus of light source of FIG.

10 and the apparatus of light source of FIG. 8 lies in that the discharge layer 408 is disposed on the cathode structure 402*b* and between the reflective layer 414 and the fluorescent layer 406.

Based on the above, the apparatus of light source provided in the first embodiment of the present invention has a secondary electron generating layer. Since the ionized positive ions in the gas hit the cathode, additional secondary electrons are produced as the positive ions hit the secondary electron generating layer on the cathode structure, thus improving the light-emitting efficiency.

The apparatus of light source provided in the second embodiment of the present invention has the discharge layer disposed on the cathode structure and the anode structure, so as to reduce the operating voltage.

The apparatus of light source of the present invention can be applied in a liquid crystal display (LCD) backlight module. The apparatus of light source can improve the light-emitting intensity and uniformity, so as to save the cost of the light guide plate and diffusion sheet needed by the cold cathode fluorescence lamp (CCFL). The apparatus of light source of the present invention combines the advantages of plasma and field-emission light sources. The apparatus of light source of the present invention uses the conductive characteristic of rarefied gas to easily conduct the electrons from the cathode structure, such that the difficulty in fabricating cathode of the field-emission light source can be overcome.

The apparatus of light source of the present invention is applied in a thin LCD backlight module of a personal computer, a home TV set, a car TV set or other relevant objects, this kind of field-emission light emitting apparatus has the advantages of power-saving, short response time, and high light-emitting efficiency, easy to fabricate, and environment friendly (mercury free).

Compared with the conventional field-emission light source apparatus, since the cathode structure of the apparatus of light source of the present invention is only a planar metal or conductive film structure without being particularly treated and having other material, and thus the structure is simple. Moreover, the present invention does not need a high-vacuum packaging, so the manufacturing process is simplified, which facilitates mass production. The cathode metal structure/high-reflective material in the transmissive structure and the anode metal structure/high-reflective structure in the reflective structure can increase reflectivity and improve brightness and light-emitting efficiency.

The wavelength of the light emitted by the present invention depends upon the type of the fluorescent powder, and the light source or backlight module having different wavelength ranges can be designed according to different purposes of use in illumination and display. The present invention can be designed as a planar or a curved backlight module. In the present invention, the reflective layer in the reflective light source apparatus can avoid the light guide phenomenon, thus improving the brightness and light-emitting efficiency. Furthermore, if a grounding circuit design is used, the charge accumulation in fluorescent powder can be eliminated.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims and their equivalents.

What is claimed is:

1. An apparatus of light source, comprising:
a cathode structure;
an anode structure, facing the cathode structure;
a secondary electron generating layer, located on the cathode structure;
a fluorescent layer, located between the cathode structure and the anode structure; and
a low-pressure gas layer, filled between the cathode structure and the anode structure, and having an electrical conducting effect, wherein a gas pressure of the low-pressure gas layer is in a range of $1\times10^{-2}$–$1\times10^{-3}$ torr,
wherein the low-pressure gas layer has an electron mean free path for allowing at least sufficient amount of electrons to directly hit the fluorescent layer under an operating voltage.

2. The apparatus of light source as claimed in claim 1, wherein the secondary electron generating layer comprises a material liable to produce electrons.

3. The apparatus of light source as claimed in claim 2, wherein the material liable to produce electrons comprises magnesium oxide (MgO), terbium oxide ($Tb_2O_3$), lanthanum oxide ($La_2O_3$), or cerium oxide ($CeO_2$).

4. The apparatus of light source as claimed in claim 1, further comprising a sidewall structure used for separating the cathode structure from the anode structure, and forming a closed space to form the low-pressure gas layer.

5. The apparatus of light source as claimed in claim 1, wherein the anode structure is a light transmissive structure.

6. The apparatus of light source as claimed in claim 1, further comprising a reflective layer located on the anode structure and between the fluorescent layer and the anode structure.

7. The apparatus of light source as claimed in claim 6, wherein the cathode structure is a light transmissive structure.

8. An apparatus of light source, comprising:
a cathode structure;
an anode structure, facing the cathode structure;
a discharge layer, located on at least the cathode structure or the anode structure;
a fluorescent layer, located between the cathode structure and the anode structure; and
a low-pressure gas layer, filled between the cathode structure and the anode structure, and having an electrical conducting effect, wherein gas pressure of the low-pressure gas layer is in a range of $1\times10^{-2}$–$1\times10^{-3}$ torr,
wherein the low-pressure gas layer has an electron mean free path for allowing at least sufficient amount of electrons to directly hit the fluorescent layer under an operating voltage.

9. The apparatus of light source as claimed in claim 8, wherein the discharge layer is located on the cathode structure.

10. The apparatus of light source as claimed in claim 8, wherein the discharge layer is located on the anode structure.

11. The apparatus of light source as claimed in claim 8, wherein the discharge layer is located on the cathode structure and the anode structure.

12. The apparatus of light source as claimed in claim 8, wherein the discharge layer comprises a material liable to discharge.

13. The apparatus of light source as claimed in claim 12, wherein the material liable to discharge comprises a metal.

14. The apparatus of light source as claimed in claim 12, wherein the material liable to discharge comprises carbon nanotube, carbon nanowall, or nanocarbonaceous material.

15. The apparatus of light source as claimed in claim 12, wherein the material liable to discharge comprises a columnar zinc oxide (ZnO), or ZnO film.

16. The apparatus of light source as claimed in claim 8, further comprising a sidewall structure used for separating the cathode structure from the anode structure, and forming a closed space to form the low-pressure gas layer.

17. The apparatus of light source as claimed in claim 8, wherein the anode structure is a light transmissive structure.

18. The apparatus of light source as claimed in claim 8, further comprising a reflective layer located on the anode structure and between the fluorescent layer and the anode structure.

19. The apparatus of light source as claimed in claim 18, wherein the cathode structure is a light transmissive structure.

20. The apparatus of light source as claimed in claim 1, wherein the secondary electron generating layer is directly disposed on the cathode structure.

* * * * *